US009145280B2

(12) United States Patent
Yale et al.

(10) Patent No.: US 9,145,280 B2
(45) Date of Patent: Sep. 29, 2015

(54) MULTI PART SYNTHETIC EYE AND EYE SLING

(71) Applicant: Yale Cordage Inc., Saco, ME (US)

(72) Inventors: Thomas L. Yale, West Boothbay Harbor, ME (US); Richard W. Hildebrand, New Gloucester, ME (US)

(73) Assignee: Yale Cordage Inc., Saco, ME (US)

( * ) Notice: Subject to any disclaimer, the term of this patent is extended or adjusted under 35 U.S.C. 154(b) by 0 days.

(21) Appl. No.: 14/210,880

(22) Filed: Mar. 14, 2014

(65) Prior Publication Data

US 2014/0265390 A1 Sep. 18, 2014

Related U.S. Application Data

(60) Provisional application No. 61/789,830, filed on Mar. 15, 2013.

(51) Int. Cl.
*B66C 1/12* (2006.01)
*D07B 1/18* (2006.01)

(52) U.S. Cl.
CPC .... *B66C 1/12* (2013.01); *D07B 1/18* (2013.01)

(58) Field of Classification Search
CPC ..... B66C 1/12
USPC ..... 294/74, 86.42; 57/237
See application file for complete search history.

(56) References Cited

U.S. PATENT DOCUMENTS 2,082,828 A * 6/1937 McClintock ..... 87/8
2,142,642 A * 1/1939 Garris ..... 87/8
2,299,568 A * 10/1942 Dickey ..... 87/8
2,430,071 A * 11/1947 Mitchell ..... 87/8
3,008,287 A * 11/1961 Crandall ..... 57/202
3,079,192 A * 2/1963 Otley ..... 294/74
3,436,114 A * 4/1969 Lange et al. ..... 294/74
3,583,749 A * 6/1971 Hopkins ..... 294/74
3,672,006 A * 6/1972 Fidrych ..... 24/122.6
4,025,100 A 5/1977 Bridgehouse
4,036,101 A * 7/1977 Burnett ..... 87/8
4,043,581 A 8/1977 St. Germain
4,240,659 A * 12/1980 St. Germain ..... 294/74

(Continued)

FOREIGN PATENT DOCUMENTS

KR 1020110110414 A 10/2011
KR 2020120002560 U 4/2012

OTHER PUBLICATIONS

PCT Search Report for PCT Application No. PCT/US2014/027232, dated Jul. 17, 2014, 13 pages.

(Continued)

*Primary Examiner* — Gabriela Puig
(74) *Attorney, Agent, or Firm* — Maine Cernota & Rardin

(57) ABSTRACT

A system for applying a tensile load, the system having: a length of continuous synthetic rope having first and second bitter ends; the continuous synthetic rope being woven with itself to create a sling; the first and second bitter ends of the rope being capable of moving relative to each other and the sling. The system may be configured such that movement of the bitter ends relative to the sling or each other is observable or measurable. Systems may be slings that provide a plurality of wraps of a continuous synthetic rope having loops at opposing ends; the plurality of wraps of continuous synthetic rope having at least three parts and being woven such that the resulting woven sling has at least three picks.

19 Claims, 5 Drawing Sheets

(56) References Cited

U.S. PATENT DOCUMENTS

| | | | | |
|---|---|---|---|---|
| 5,058,243 | A * | 10/1991 | Rasmussen | 24/68 R |
| 5,436,044 | A * | 7/1995 | Pinkos | 428/36.1 |
| 5,561,973 | A * | 10/1996 | St. Germain | 57/22 |
| 5,592,977 | A * | 1/1997 | Kikuchi et al. | 139/387 R |
| 6,381,939 | B1 * | 5/2002 | Brown et al. | 57/202 |
| 7,399,018 | B1 | 7/2008 | Khachaturian | |
| 2011/0215601 | A1 * | 9/2011 | Mueller | 294/74 |
| 2014/0070557 | A1 * | 3/2014 | Mozsgai et al. | 294/74 |

OTHER PUBLICATIONS

Products page from JiliSling website, http://www.julisling.com/eng/product/product_list.asp?cid=68&fid=8, 2 pages, obtained Aug. 11, 2014.

Products page from JiliSling website, http://www.julisling.com/eng/product/html/BZ_gsssj_0000377.htm, 2 pages, obtained Sep. 12, 2014.

Products page from JiliSling website, http://www.julisling.com/eng/product/product_list.asp?cid=65&fid=8, 2 pages, obtained Aug. 11, 2014.

Products page from JiliSling website, http://www.julisling.com/eng/product/product_list.asp?cid=29&fid=4, 2 pages, obtained Aug. 11, 2014.

Products page from JiliSling website, http://www.julisling.com/eng/product/product_list.asp?cid=66&fid=8, 2 pages, obtained Aug. 11, 2014.

Products page from JiliSling website, http://www.julisling.com/eng/product/html/BZ_gsssj_0000376.htm, 2 pages, obtained Sep. 12, 2014.

Products page from JiliSling website, http://www.julisling.com/eng/product/product_list.asp?cid=28&fid=4, 2 pages, obtained Aug. 11, 2014.

Products page from LiftAll website, http://www.lift-all.com/products-slings.php, 2 pages, obtained Sep. 12, 2014.

Products page from SlingMax website, http://slingmax.com/category/synthetic-slings/, 3 pages, obtained Sep. 12, 2014.

Products page from SlingMax website, http://slingmax.com/category/wire-rope-slings/, 3 pages, obtained Sep. 12, 2014.

Pages from LiftAll Round Sling Catalog, 15 pages, accessed from Products page from LiftAll website, http://www.lift-all.com/products-slings.php, obtained Sep. 12, 2014.

Pages from LiftAll WebSling Catalog, 25 pages, accessed from Products pages from LiftAll website, http://www.lift-all.com/products-slings.php, obtained Sep. 12, 2014.

Pages from LiftAll Wire Rope Sling Catalog, 22 pages, accessed from Products page from LiftAll website, http://www.lift-all.com/products-slings.php, obtained Sep. 12, 2014.

* cited by examiner

MULTI PART SYNTHETIC EYE AND EYE SLING

RELATED APPLICATIONS

This application claims the benefit of U.S. Provisional Application No. 61/789,830, filed Mar. 15, 2013. This application is herein incorporated by reference in its entirety for all purposes.

FIELD OF THE INVENTION

The invention relates to slings, and more particularly, to a synthetic rope multi-cable woven sling.

BACKGROUND OF THE INVENTION

Eye and eye lifting slings exist in various forms made of metals and synthetics in single element form and in multi part or element form. In metal or wire rope a sling may be formed by utilizing a single length of wire and forming an eye in each end by splicing, swaging, or potting. In synthetic form a sling may be formed similarly by utilizing a single length of rope (of any construction such as 3 strand, single braid, double braid, parallel, plaited, etc.) and forming an eye in each end by splicing, swaging, knotting, potting, etc. Flat synthetic webbing is also widely used to make slings by folding an eye in each end and stitching the bitter end to the standing part of the webbing, thus forming eyes that can be attached between an object to be lifted and to an apparatus designed to exert a lifting force. Synthetic slings are also formed by utilizing a strength element such as a twisted strand of fibers (or braided element) and laying a continuous length in a circular path making multiple laps until a desired combined strength is achieved and then enclosing these strands within a "sock" of suitable cloth type material.

Each of these various types of slings has advantages and disadvantages. The biggest difference between wire based slings versus synthetic slings is weight. For a given lift capacity, the synthetic alternative is 4 to 10 times lighter. Wires' principle advantages are high abrasion resistance, high UV resistance, high temperature tolerance, and cheaper initial cost. Its disadvantages are high weight, stiffness, low corrosion resistance, abrasive to other objects, high conductivity, loss of strength in smaller bend diameters, difficulty of inspection (because of weight) and high recoil and springback. Synthetic slings (of high strength fibers such as aramids, ultra high molecular weight polyethylene, liquid crystal polymers, etc.) are much lighter to handle, non-corrosive, non-abrasive to other objects, very flexible, easy to store and have better strength retention over small diameter pins and lift hooks, and have low to no conductivity.

The disadvantages of current synthetic slings are higher cost, lower tolerance to high temperatures, difficult to inspect (sleeve enclosed strength fibers), cannot be pushed (as in under objects), lower tolerance to UV degradation, prone to contamination and moisture penetrating to the strength elements, easily cut and bulky. When wire slings are fabricated for higher lifting capacity, a typical method is to use multiple strands or "parts" of a given size of wire. This is primarily done because of the difficulty of bending a larger single wire rope into a manageable eye size and the associated loss of strength when bent too sharply. Typically, the wire is fabricated into a 3 part (or pass) configuration. Then two or three "matched" sets of the 3 part slings are combined to form a 6 or 9 part sling. The current invention is an improvement over this type of multipart sling utilizing synthetic strength elements configured or fabricated in a more efficient product, such that the advantages of wire style and synthetic style slings are embodied while eliminating or minimizing the disadvantages.

What is needed, therefore, are techniques for manufacturing synthetic slings of lower cost and higher performance.

SUMMARY OF THE INVENTION

One embodiment of the present invention provides a system for applying a tensile load, the system comprising: a length of continuous synthetic rope having first and second bitter ends; the continuous synthetic rope being woven with itself to create a sling; the first and second bitter ends of the rope being capable of moving relative to each other and the sling.

Another embodiment of the present invention provides such a system further comprising markings disposed on the first and the second bitter ends showing movement of the first and second bitter ends relative to each other.

A further embodiment of the present invention provides such a system further comprising measurement indicia disposed along the continuous synthetic rope showing elongation of the rope.

One embodiment of the present invention provides a system for applying a tensile load, the system comprising:

a plurality of wraps of a continuous synthetic rope having loops at opposing ends;

the plurality of wraps of the continuous synthetic rope having at least three parts and being woven such that the resulting woven sling has at least three picks.

Another embodiment of the present invention provides such a system wherein each wrap within the plurality of wraps is configured to move relative to other wraps within the plurality of wraps.

A further embodiment of the present invention provides such a system wherein individual wraps are configured to shift relative to each other and to conform to a holder and seek an optimal load bearing configuration of the wraps when the sling is placed under load.

Still another embodiment of the present invention provides such a system wherein the wraps in the plurality move relative to each other to be substantially equally loaded when a load is applied to the sling.

A still further embodiment of the present invention provides such a system wherein the load approaches a design load of the sling.

Yet another embodiment of the present invention provides such a system wherein the wraps are configured to decrease movement relative to each other when a load approaching a design load of the sling is applied.

A yet further embodiment of the present invention provides such a system wherein the inside radius of each wrap forming a portion of the loops is independently assumed in load distribution balance with its neighboring wraps when the sling is placed under load.

Even another embodiment of the present invention provides such a system wherein the sling is torsionally neutral.

An even further embodiment of the present invention provides such a system wherein the sling is non-conductive when dry.

Still yet another embodiment of the present invention provides such a system wherein the sling has a mechanical resonance less than 0.1 that of a steel sling of comparable design load.

A still yet further embodiment of the present invention provides such a system wherein the wraps are substantially free of sharp edges.

Even yet another embodiment of the present invention provides such a system wherein the rope comprises a primary strength member and a jacket disposed over the primary strength member.

An even yet further embodiment of the present invention provides such a system wherein the ratio of the bending strength of the sling divided by its column strength is less than 10% of a steel sling.

An even still further embodiment of the present invention provides such a system wherein the sling has a pushability such that the sling without external support will vertically support a length of itself not less than about 5 times the circumference of the sling.

Another yet further embodiment of the present invention provides such a system further providing visual indicia disposed on bitter ends of the rope, such that movement of the bitter ends relative to each other is observable and measurable.

One embodiment of the present invention provides a pushable woven synthetic sling retaining a high translation, the sling comprising: a synthetic rope disposed in a plurality of wraps; the plurality of wraps being woven in a weave having a weave angle $\alpha$, the wraps shifting relative to each other such that a load on the sling is distributed evenly among the wraps but the wraps do not unweave, the shifting ability of the wraps being diminished in approximate proportion with the increase of the weave angle $\alpha$ and load applied to the sling.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
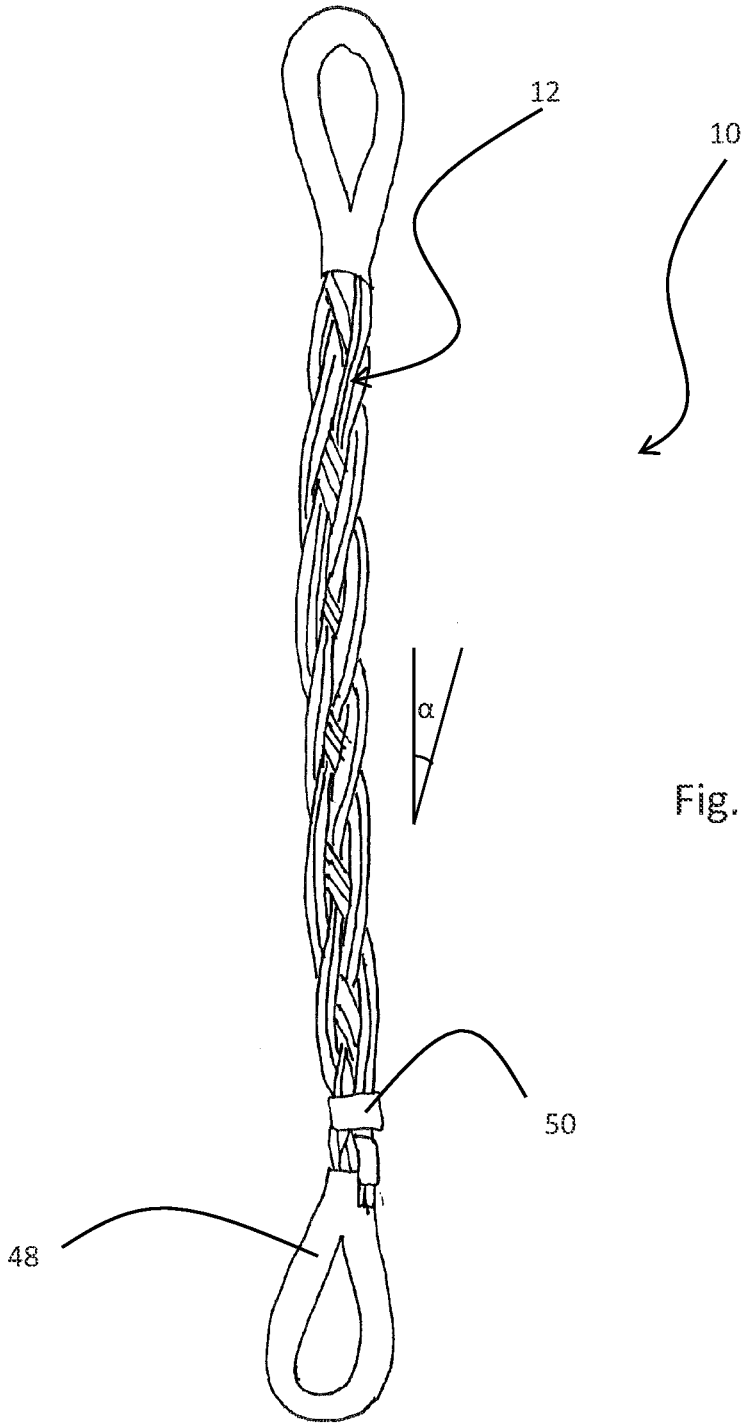
FIG. 1 is a plan view illustrating a synthetic cable sling configured in accordance with one embodiment of the present invention.

One embodiment of the present invention, illustrated in FIG. 1 provides a sling 10 of braided synthetic rope or cable 12. Such a sling 10 would have a lighter weight than steel wire or known synthetic round sling of equal lift capacity, with less bulk than the known synthetics. Such a sling 10 would be configured to exhibit very high resistance to UV degradation. One embodiment of the present invention uses higher fiber efficiency than known synthetic sling systems and higher strength retention over small diameters than wire. While this invention has been discussed in regards to lifting, one skilled in the art will appreciate that eye and eye slings are used in a variety of applications, including but not limited to lifting, restraining, stabilizing, pulling, and suspending loads.

A sling 10 configured in accord with one embodiment of the present invention provides a plurality of wraps of a synthetic rope which are woven together, creating a plurality of picks. A pick count is defined in the industry under International Standard CI1202 as adopted by American Standards for Testing and Materials (ASTM International) as "In a braided rope, the number of strands rotating in one direction in one cycle length divided by the cycle length. Each multiple Strand with multiple yarns should be counted as one strand. Pick count is normally expressed in picks per inch." See International Standard CI1202-03, p. 5.

In one embodiment there are not fewer than three picks. Each pick may be made using a number of parts (i.e. rope segments), at least three such parts are necessary, and while possible, parts in excess of 15 may be of diminished practical value and increase production cost. The angle $\alpha$ of each part within a pick relative to the longitudinal axis of the sling as a whole affects the ability of wraps within the sling to reach equilibrium in load sharing by their relative movement. The design of a sling must, therefore, consider and balance the benefits of increased translation efficiency from lower angles against the consequent diminution of elongation and energy absorption which could be obtained at higher angles.

Five functional performance parameters are directly and predictably affected by the change in the weave angle of the invention according to the relationship "Cosine $\alpha$";

Pushability
Translation
Elongation
Adjustment Potential among the individual wraps
The Force of Constriction Pushability is the ability of one embodiment of the present invention, when vertically disposed, to sustain its own weight without collapse. Pushability increases with an increasing weave angle, offset by an increasing unit weight.

Translation is the percent of theoretical tensile load achievable divided into the actual tensile load capacity. This percentage diminishes as the angle increases.

Elongation is the extension potential within the rope itself, i.e. how much the rope can stretch, plus the mechanical extension potential within the woven sling. Both of these potentials increase with the braid angle, but reach their respective limits, of about 3.5% and 4% respectively, before the angle increases much beyond 30 degrees or so. The actual limits and corresponding angles depend upon fiber, rope construction, coatings, and other factors.

Adjustment potential of the individual wraps with respect to each other also increases but is impeded by increases in friction, among wraps in mutual contact, with an increasing weave angle. Friction is the direct result of the frictional coefficient of the rope surface multiplied by the "Normal" Force. The Normal Force is the reactionary force to the Force of Constriction created by an applied load to the sling.

The Force of Constriction rises with an increasing weave angle and is a characteristic of virtually anything stretched and therefore subjected to "Stretcher Reduction". That is, something with a uniform starting state and which is uniformly stretched will reduce in diameter or girth in direct proportion to its extension. Because the invention is a "composite" device and therefore not entirely uniform, stretcher reduction and its inherent forces are not easily predicted, analytically. Nevertheless, the Force of Constriction and therefore the Normal Force causing friction has a significant impact on wrap adjustment potential.

Thus, the various embodiments of the present invention utilize the properties listed above to optimize the utility, safety, convenience, and therefore value to the user, and very favorably so in contrast to other competing products.

A sling 10 configured according to the embodiments of the present invention allows for easier and more thorough inspection. It is configured with sufficient rigidity to be "pushed", under objects and through gaps unlike known synthetic systems which are too limp, while being more flexible and with lower energy recoil than that steel slings. As one of ordinary skill in the art would appreciate, this allows storage in smaller spaces.

Such a sling 10 would exhibit higher abrasion and cut resistance and higher temperature resistance than known synthetics and be less abrasive and more corrosion resistant that steel systems. In one embodiment, strength elements are sealed from moisture and contaminates.

One embodiment of the present invention would provide lower point loading than wire slings through broader load spreading. The system would provide low to no conductivity.

As illustrated in FIG. 1, one embodiment of the present invention is a sling 10 constructed from a synthetic rope or cable 12 such as UNITREX™ (manufactured by Yale Cordage) synthetic cable. Various embodiments of the invention can utilize an appropriate variety of fiber as the strength member or jacketing material. As an example, the primary load bearing fiber could be an aramid (Kevlar®, Technora®, Twaron®), ultra high molecular weight polyethylene (UHMWPE) (Spectra®, Dyneema®), liquid crystal polymer (Vectran®), PBO (Zylon®), glass, carbon, etc.

Figure 2:
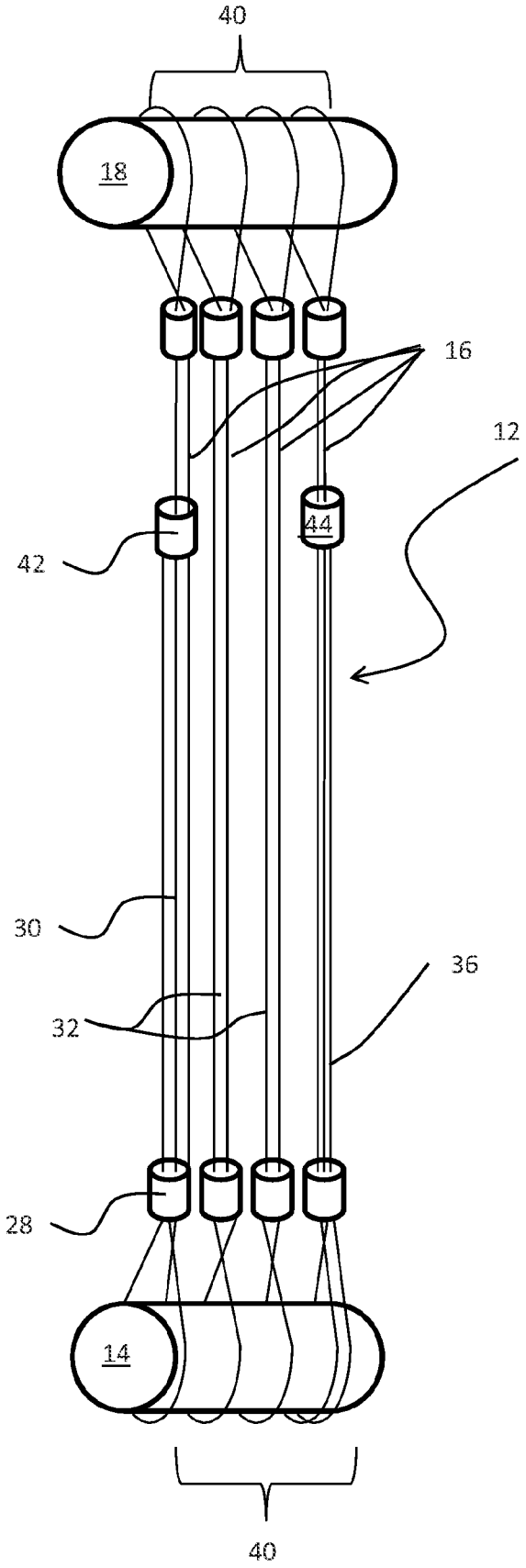
FIG. 2 is a diagram illustrating a wrapping of a synthetic cable sling configured in accordance with one embodiment of the present invention.

The sling 10 configured in accordance with one embodiment of the present invention is woven into an eye and eye sling by the following method(s):

As illustrated in FIG. 2 suitable length of rope 12 is wound in laps 16 around two opposing pins 14, 18 of appropriate diameter (typically 4 to 12 times the rope diameter) such that 2 laps are needed for a 2 part sling, 3 laps for a 4 part, 4 laps for a 6 part, 5 laps for an 8 part, 6 laps for a 10 part, and so on. In one embodiment that is illustrated in FIG. 2, a stage in construction of an 8 part sling 10 is shown: A flow chart of the construction is illustrated in FIG. 8. Five laps 16 are wound around the pins 14, 18. One skilled in the art will appreciate that the numbers of wraps 16 are based on the desired number of parts to the sling.

Figure 3:
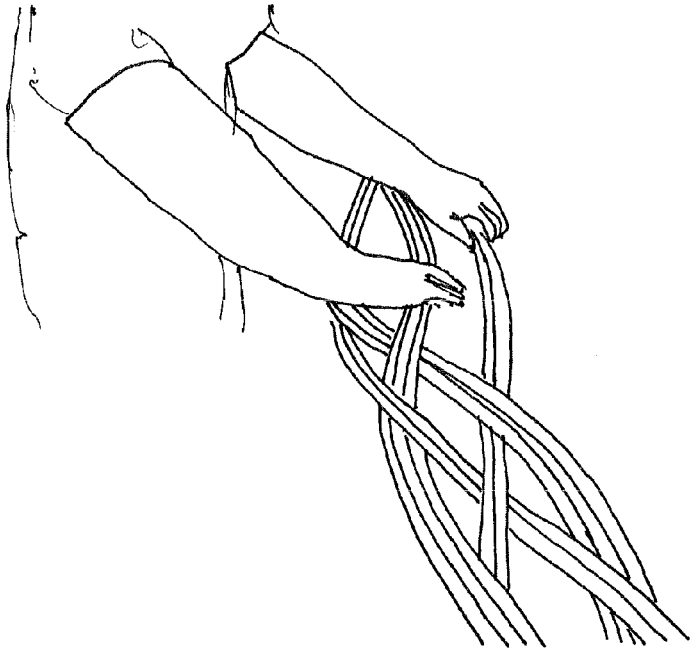
FIG. 3 is a perspective view illustrating braiding of a synthetic cable sling configured in accordance with one embodiment of the present invention.
Figure 4:
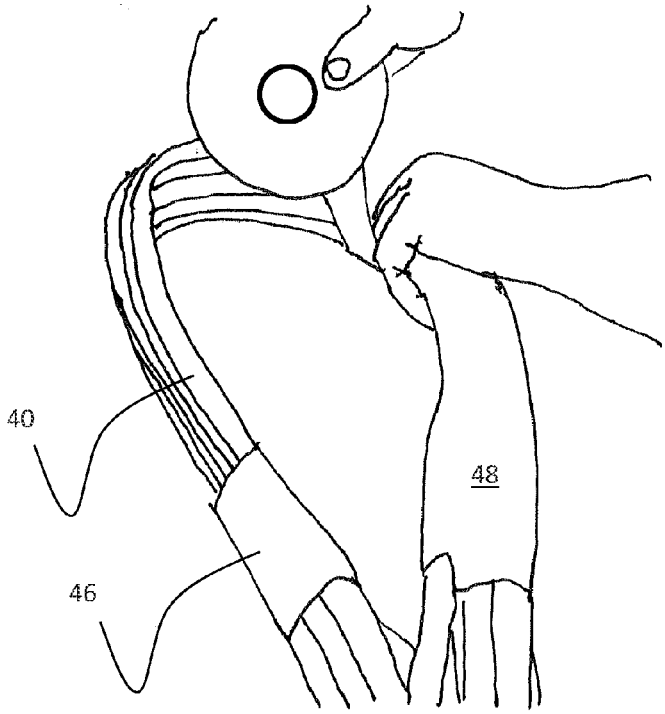
FIG. 4 is a perspective view illustrating wrapping an eye of a synthetic cable sling configured in accordance with one embodiment of the present invention with anti-chafing protective material.
Figure 5:
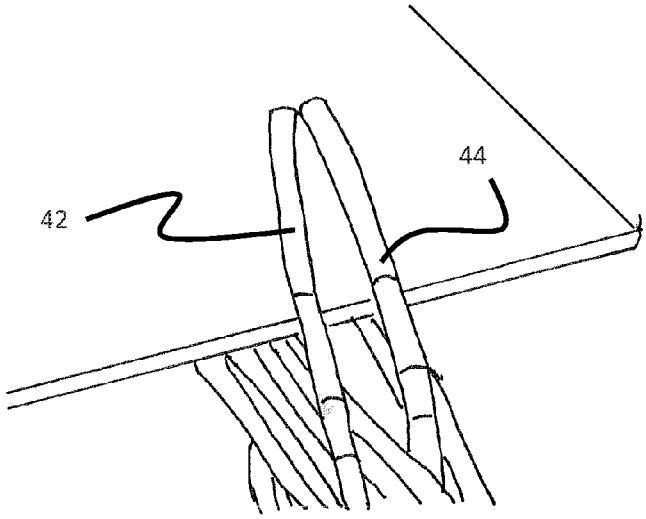
FIG. 5 is a perspective view illustrating termination of a synthetic cable sling configured in accordance with one embodiment of the present invention.
Figure 6:
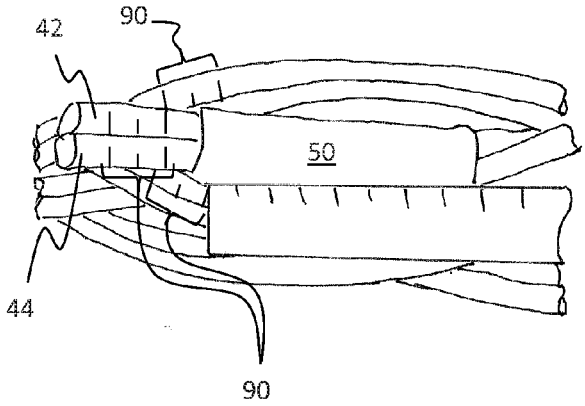
FIG. 6 is a perspective view illustrating securing ends of a synthetic cable sling configured in accordance with one embodiment of the present invention having markings or indicia of movement.

The eyes on the two pins are taped (or seized) 28 forming four distinct eyes 40 on each end. A first end 42 is temporarily taped to a first lap 30 (top eye) and a second end 44 to a last lap (bottom eye) 36. Following the groups formed at pin 18 back to pin 14 and tape 28 the groups together at pin 14. The first group 30 will have 3 elements of rope the middle groups 32 will have 2 elements rope and the last group 36 will have 3 elements rope. The eyes 40 are lifted off of pin 18 and are braided with, in one embodiment, a 4 end braid with the lay length of 26 to 40 times the diameter of the rope 12 (or other element), as illustrated in FIG. 3. One skilled art will appreciate that a number of lay lengths is required to ensure that the braid is properly bound to prevent release of the cables from the braid. It has been found that the number of lay lengths required is not fewer than 3. While the term "braid" has been used to describe the sling, the ropes may be combined through any appropriate combination, including but not limited to weaving, splicing, braiding, tatting, or darning to allow for multiple rope lengths interlocking and forming a sling. The throat 46 of bundled eyes 40 at each end are then seized and may be wrapped with an appropriate chafe protection material 48 (FIG. 4). As illustrated in FIG. 5, ends 42 and 44 are then untaped and exposed (short of the start of the eyes at pin 18) and then paired parallel and trimmed so they are the same length. As illustrated in FIG. 6 heavy wall "cold shrink" tube 50, of a length at least 4 times the diameter of the rope 12 is then passed over the two ends 42, 44 and secured in place by removing the internal coil.

One skilled in the art will appreciate that the outer cover material could be anyone of these materials to suit a particular purpose such as high heat resistance that would dictate glass, carbon, or Kevlar® fiber.

The outer material could also be an extrusion to minimize conductivity under wet conditions.

The two ends 42, 44 that are held by the cold shrink tubing serve as indicators that the sling elements are not becoming unbalanced. If overloading takes place or if the elements become unbalanced, the 2 ends 42, 44 will become uneven in length or move relative to surrounding assembly. Similarly, indicia or markings 90 may be made on the whole rope or some part thereof to indicate changes in alignment of the ends relative to themselves or the sling or elongation or distention of some part of the rope in the sling.

In one embodiment of the present invention, the ends 42, 44 of the rope are left un-spliced. While it was expected that splicing of the ends would be required to achieve an efficiency of 70%, this was found not to be the case. Not only was it unnecessary to splice them but it was discovered that the method yields a translation of between 70% to 90%. The method in fact accommodates element equalization to achieve this high conversion. It also has the advantage of providing for an imbalance indicator as well as being less time consuming to fabricate.

Figure 7:
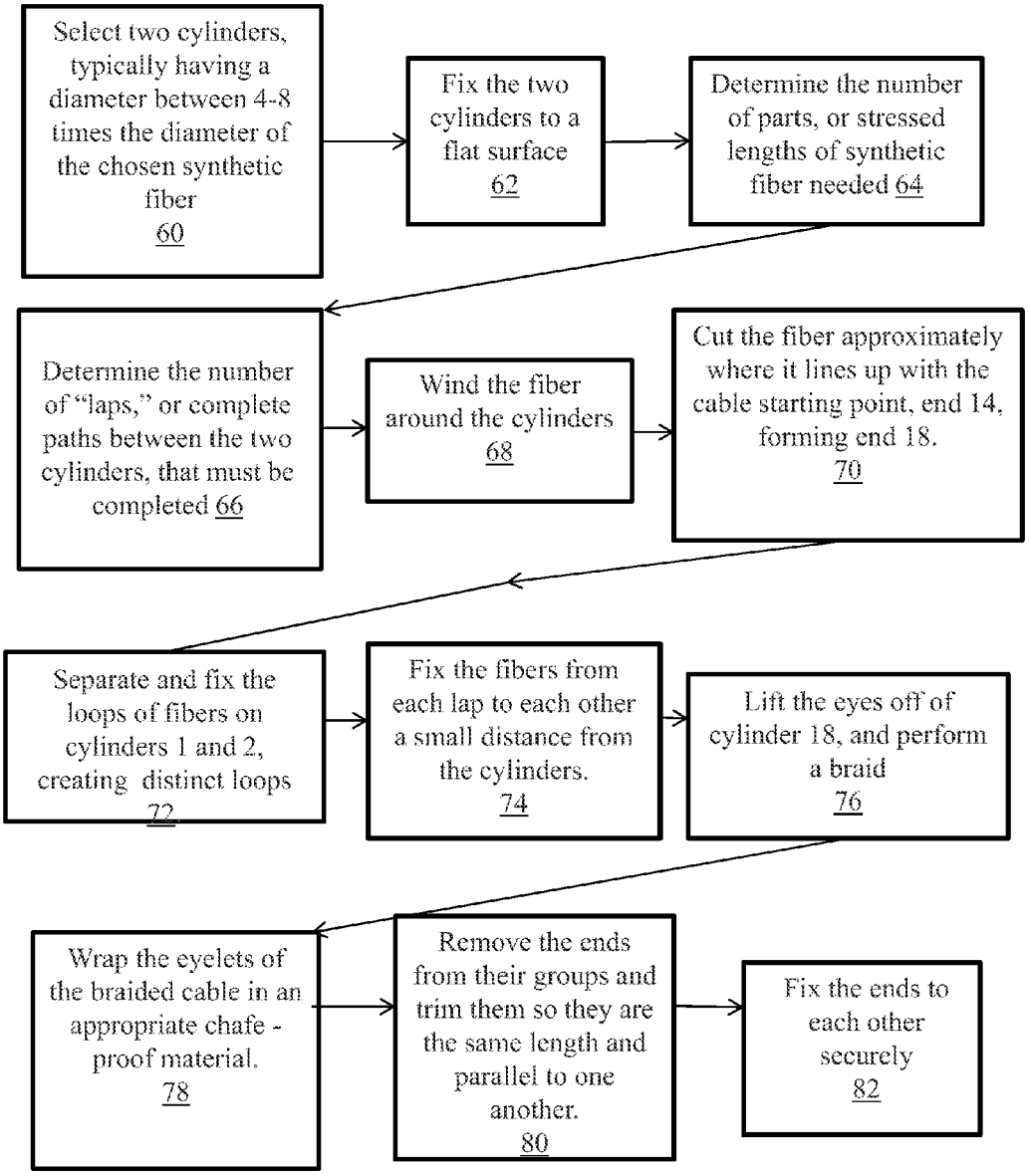
FIG. 7 is a flow chart illustrating a method for manufacturing synthetic cable sling configured in accordance with one embodiment of the present invention.

The method as illustrated in the flow chart of FIG. 7 includes: Select two cylinders, typically having a diameter between 4-12 times the diameter of the chosen synthetic fiber 60. Then the two cylinders are fixed to a flat surface 62. The number of parts, or stressed lengths of synthetic fiber needed are determined 64 as are the number of "laps," or complete paths between the two cylinders, that must be completed 66. Fiber is wrapped around the cylinders 68 and cut 70 approximately where it lines up with the cable starting point, end 42, forming end 44. The loops of fibers are separated and fixed 72 on cylinders 14 and 18, creating distinct loops and bundled or fixed into laps proximate to each cylinder 74. Loops thus formed are lifted from cylinder 18, and braided 76. Loops are aligned and bundled to form eyelets and secured in appropriate anti-chafe material 78. The ends, 42, 44 are removed from their tape and trimmed so that the ends are flush or parallel with each other 80. The ends are then fixed securely to each other 82 by applying a self-amalgamating tape or a cold shrink tube to the ends or another attachment system that allows for secure retention of the ends while allowing the ends to move relative to each other.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A system for applying a tensile load, the system comprising:

a length of a single continuous synthetic rope having first and second bitter ends;

said continuous synthetic rope being braided with itself to create a sling;

wherein when a force is applied to said sling said force is distributed over said sling such that no substantial said force is applied to said first and second bitter ends from a point at which said first and second bitter ends exit said braid.

2. The system of claim 1 further comprising markings disposed on said first and said second bitter ends showing movement of said first and second bitter ends relative to each other.

3. The system of claim 1 further comprising markings disposed on said continuous synthetic rope showing movement of said first and second bitter ends relative to said sling.

4. The system of claim 1 further comprising measurement indicia disposed along said continuous synthetic rope showing elongation of said rope.

5. The system of claim 1, wherein said sling has a plurality of wraps having loops at opposing ends; and said plurality of wraps of said continuous synthetic rope having at least three parts and being braided such that the resulting braided sling has at least three picks.

6. The system of claim 5 wherein said braided sling is configured such that each wrap in said plurality of wraps moves relative to other wraps within said plurality of wraps.

7. The system of claim 6 wherein wraps are configured to shift relative to each other and to conform to a holder and seek an optimal load bearing configuration of the wraps when the sling is placed under load.

8. The system of claim 7 wherein said load approaches a design load of said sling.

9. The system of claim 6 wherein said wraps in said plurality move relative to each other to be substantially equally loaded when a load is applied to said sling.

10. The system of claim 6 wherein said wraps are configured to decrease movement relative to each other when a load approaching a design load of said sling is applied.

11. The system of claim 5 wherein the inside radius of each wrap forming a portion of said loops is independently assumed in load distribution balance with its neighboring wraps when the sling is placed under load.

12. The system of claim 5 wherein said sling is torsionally neutral.

13. The system of claim 5 wherein said sling is non-conductive when dry.

14. The system of claim 5 wherein said sling has a mechanical resonance less than 0.1 that of a steel sling of comparable design load.

15. The system of claim 5 wherein said wraps are substantially free of sharp edges.

16. The system of claim 5 wherein the ratio of the bending strength of the sling divided by its column strength is less than 10% of a steel sling.

17. The system of claim 5 wherein said sling has a pushability such that said sling will vertically support a length of itself not less than 5 times the circumference of said sling.

18. The system of claim 5 further providing visual indicia disposed on bitter ends of said rope, such that movement of bitter ends of said continuous synthetic rope relative to each other is observable.

19. The system of claim 5 further providing visual indicia disposed on said continuous synthetic rope, such that movement of bitter ends of said continuous synthetic rope relative to said braided sling is observable.

* * * * *